United States Patent [19]

Ito et al.

[11] Patent Number: 4,527,535

[45] **Date of Patent: * Jul. 9, 1985**

[54] IGNITION SYSTEM INCLUDING IGNITION DISTRIBUTOR INTEGRATED WITH IGNITION COIL

[75] Inventors: Teruyoshi Ito, Kariya; Shigeya Abe, Aichi, both of Japan

[73] Assignee: Nippondenso Co., Ltd., Kariya, Japan

[ * ] Notice: The portion of the term of this patent subsequent to Oct. 12, 1999 has been disclaimed.

[21] Appl. No.: 601,339

[22] Filed: Apr. 17, 1984

Related U.S. Application Data

[62] Division of Ser. No. 405,906, Aug. 6, 1982, Pat. No. 4,453,526.

[30] Foreign Application Priority Data

Aug. 7, 1981 [JP] Japan ..... 56-123727

[51] Int. Cl.[3] ..... F02D 1/00

[52] U.S. Cl. ..... 123/617; 123/633

[58] Field of Search ..... 123/617, 633, 64 J, 123/647, 634, 146.5 A

[56] References Cited

U.S. PATENT DOCUMENTS

| | | | |
|---|---|---|---|
| Re. 28,395 | 4/1975 | McMillan | 123/617 |
| 3,073,879 | 1/1963 | Straub | 123/617 |
| 3,888,225 | 6/1975 | Bayer et al. | 123/617 |
| 4,129,107 | 12/1978 | Bayer | 123/617 |
| 4,155,341 | 5/1979 | Fernquist et al. | 123/617 |
| 4,365,609 | 12/1982 | Toyama et al. | 123/617 |

*Primary Examiner*—Raymond A. Nelli

*Attorney, Agent, or Firm*—Cushman, Darby & Cushman

[57] ABSTRACT

In an ignition system including an ignition distributor integrated with an ignition coil, an electrical conductor linking leakage magnetic flux of the ignition coil is arranged on the outer periphery of the coil of an electromagnetic pickup to have a current conducting path around the axis of the coil. An eddy current is induced in the conductor by the leakage magnetic flux to generate magnetic flux in the direction opposite to the leakage magnetic flux of the ignition coil by the eddy current, thereby reducing a noise voltage generated in the electromagnetic pickup.

3 Claims, 10 Drawing Figures

IGNITION SYSTEM INCLUDING IGNITION DISTRIBUTOR INTEGRATED WITH IGNITION COIL

This is a division, of application Ser. No. 405,906 filed Aug. 6, 1982 now U.S. Pat. No. 4,453,526 granted June 12, 1984.

BACKGROUND OF THE INVENTION

The present invention relates to an ignition system in which an ignition distributor containing a rotation signal generator is integrated with an ignition coil and an ignition amplifier, or more in particular to such a system which is prevented from an erroneous operation or malfunction which otherwise might be caused by magnetic fluxes leaking from the ignition coil.

An ignition system generally used in an internal combustion engine is shown in FIG. 1. A signal rotor 1 having as many protrusions as the cylinders of the internal combustion engine E is rotated in synchronisum with the rotation of the engine E. The signal rotor 1 is opposed to an electromagnetic pickup 2 including a pickup coil 21 having an axis thereof in radial direction of the signal rotor and a permanent magnet 22. With the rotation of the signal rotor 1, magnetic fluxes change so that an output signal (rotation signal) is generated in synchronism with the engine rotation in the coil 21 of the pickup 2. In accordance with the output signal of this electromagnetic pickup 2, an ignition amplifier 3 controls an intermittent current flow through the primary winding 41 of the ignition coil 4 by a battery 5.

Assume that the signal rotor 1 rotates from the position where one of the protrusions thereof is opposed to the pickup 2 to the position where the next protrusion is opposed to the pickup 2. The magnetic flux produced from the permanent magnet 22 and linking the pickup coil 21 change, and an output signal voltage of a waveform shown by solid line in FIG. 2(*a*) is generated in the pickup coil 21. The ignition amplifier 3 controls the current supply at a predetermined detection level $V_0$ shown by dashed line on the basis of this output signal waveform, so as to supply a current to the primary winding 41 of the ignition coil 4 when the signal voltage is positive as compared with the detection level $V_0$ and to cut off current supply to the primary winding 41 when the signal voltage is negative. In this way, the current flowing in the primary winding 41 of the ignition coil 4 is controlled as shown in FIG. 2(*b*). The ordinate of FIGS. 2(*a*) and 2(*b*) represents the voltage V and the current i respectively, and the abscissa thereof represents time t.

When current supply to the primary winding 41 of the ignition coil 4 is cut off, a high voltage is induced across the secondary winding 42. This high voltage is applied to a spark plug 7 of each cylinder of the engine E through distribution made by a distributor 6. The engine E is thus ignited.

In this ignition system, the signal rotor 1 is mounted on a rotary shaft of the distributor 6 and the electromagnetic pickup 2 is arranged in the distributor 6 in opposed relation thereto. In addition, it has been suggested in recent years that the ignition coil 4 and the ignition amplifier 3 are both integrated with the distributor 6 primarily for the purpose of improving the mountability thereof on the vehicle and the reliability of connecting means, as well known.

If the ignition coil is integrated with the distributor, however, an erroneous signal is liable to be generated from the electromagnetic pickup making up a rotation signal generator by the magnetic flux leaking from the ignition coil. The problem is how to overcome this difficulty.

An explanation will be made with reference to an ignition coil of closed magnetic loop type generally used as the ignition coil 4, in which a pair of E-shaped iron cores 43 and 43' are arranged in opposition to each other and include central legs wound with the primary and secondary windings 41 and 42 as shown in FIG. 3 in principle. In the case of this ignition coil, current supply to the primary winding 41 causes main magnetic flux whose axis A posses through the central legs 43*a* and 43'*a* of the E-shaped iron cores 43 and 43'. Even in this ignition coil 4 of closed magnetic loop type, as is well known, there is a leakage magnetic flux from the magnetic circuit. This leakage magnetic flux $\emptyset_L$ is generated radially from the substantial center of the E-shaped core 43 and is converged at the substantial center of the opposite E-shaped core 43'.

If this ignition coil, together with the electromagnetic pickup, is integrated with the distributor, the coil of the electromagnetic pickup is inevitably arranged so as to be linked with the leakage magnetic flux, with a natural result that a noise voltage attributable to the leakage magnetic flux is generated in the coil of the electromagnetic pickup.

Let us now consider the effect of the leakage magnetic flux on the assumption that the coil 21 of the electromagnetic pickup and the ignition coil 4 are arranged as shown in FIG. 4*a*. FIGS. 4*a* and 4*b* are sectional views of the ignition coil 4 taken along the main magnetic flux axis A attributable to the primary winding current. The pickup coil 21 has a magnetic flux sensibility in the direction X, while the leakage magnetic flux $\emptyset_L$ of the ignition coil 4 is directed from the upper end to the lower end of the main magnetic flux path.

As shown, the pickup coil 21 is arranged substantially midway of the magnetic path of the main magnetic flux axis A of the ignition coil 4 so that the magnetic flux sensitive direction X crosses the main magnetic flux axis A of the ignition coil 4 at right angles. In this case, the leakage magnetic flux $\emptyset_L$ links the magnetic flux sensitive direction X of the pickup coil 21 substantially at right angles, and any noise voltage is not superimposed.

Actually, however, it is well known that it is difficult to form such a uniform magnetic field by the leakage magnetic flux as shown in FIG. 4*a*. As shown in FIG. 4*b*, for instance, a distribution shaft 150 and the signal rotor 1 are generally inserted between the coil 21 of the electromagnetic pickup and the ignition coil 4 as described later. In this case, even though the pickup coil 21 is arranged substantially midway of the magnetic path of the main magnetic flux axis A of the ignition coil with the magnetic flux sensitive direction X crossing the main magnetic flux axis A of the ignition coil 4 in a direction perpendicular thereto, the distribution shaft 150 and the signal rotor 1 are presented as magnetic materials between the pickup coil 21 and the ignition coil 4 and hence the route of the leakage magnetic flux changes, resulting in that part of the leakage flux undesirably links the pickup coil 21. Therefore, a noise voltage caused by the leakage magnetic flux $\emptyset_L$ is thus superimposed on the output of the pickup coil 21, thereby causing an erroneous operation of the ignition amplifier 3.

SUMMARY OF THE INVENTION

Accordingly, it is an object of the present invention to provide an ignition system including an ignition coil integrated with an ignition distributor, in which an erroneous operation which otherwise might be caused by the magnetic flux leaking from the ignition coil is accurately prevented.

According to the present invention, there is provided an ignition system in which an electrical conductor linking the leakage magnetic flux of the ignition coil is arranged on the outer periphery of the coil of the electromagnetic pickup substantially coaxially with the coil so as to have a current conducting path around the axis of the coil. An eddy current is induced in the conductor by the leakage magnetic flux along the current conducting path, a magnetic flux in the opposite direction to the leakage magnetic flux of the ignition coil is generated by the eddy current, and the noise voltage generated in the electromagnetic pickup is thus reduced.

DESCRIPTION OF THE PREFERRED EMBODIMENTS

The present invention will be described in detail below with reference to an embodiment shown in the accompanying drawings.

Figure 5:
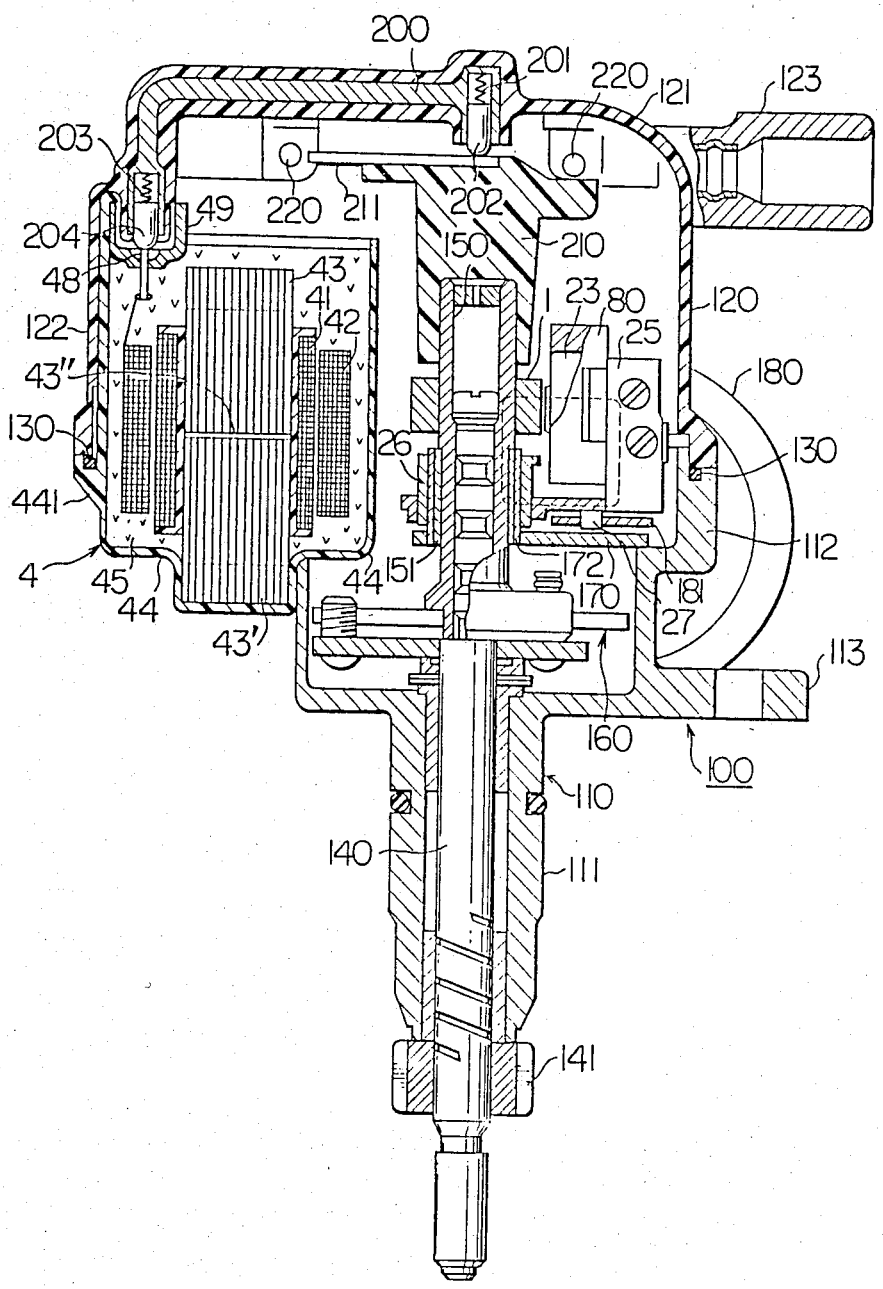
FIG. 5 is a front sectional view taken in line V—V in FIG. 6 showing an embodiment of the distributor according to the present invention.
Figure 6:
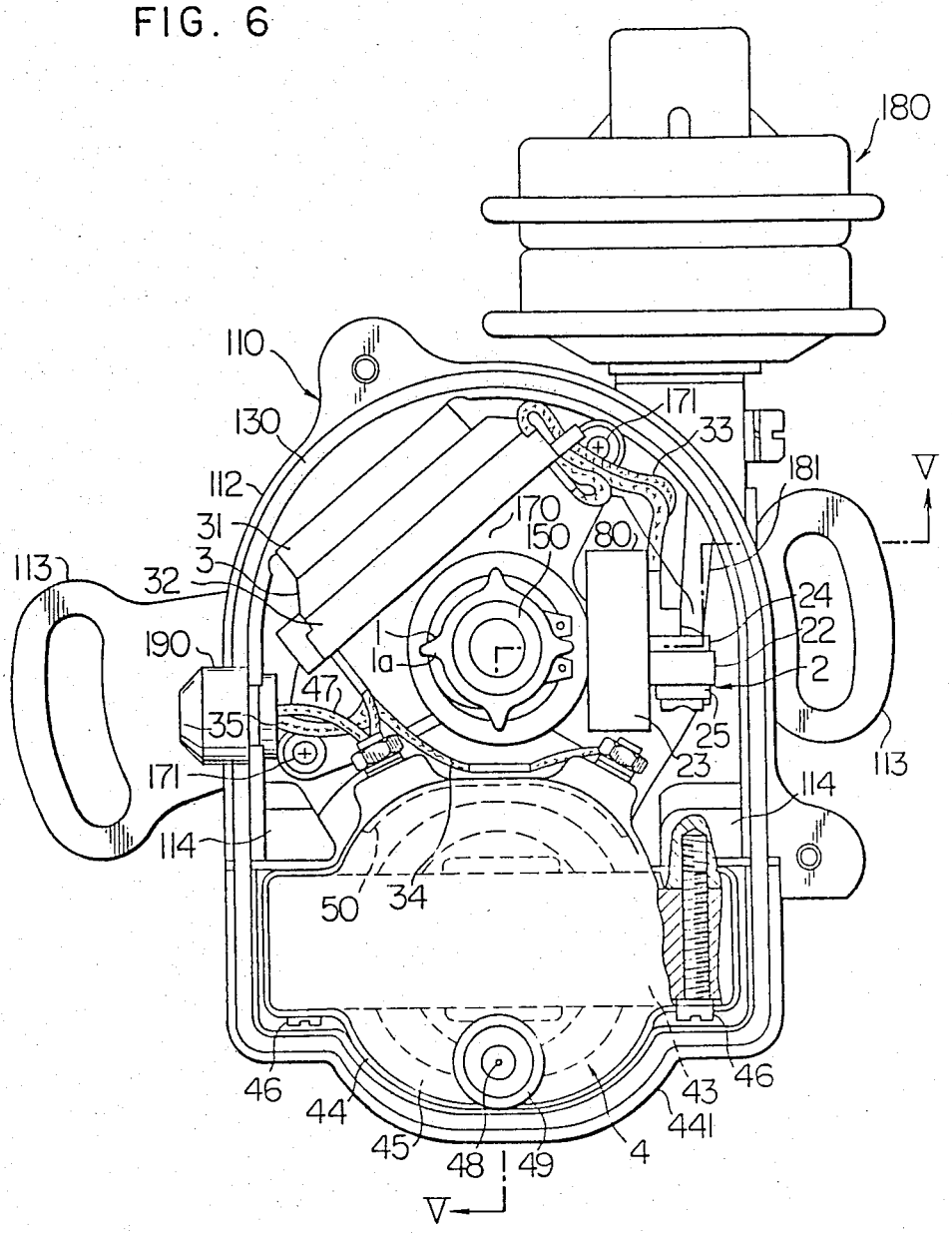
FIG. 6 is a plan view of the distributor with the cap thereof removed.
Figure 7:
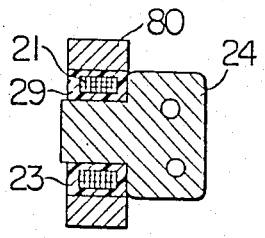
FIG. 7 is a sectional view showing an electromagnetic pickup according to an embodiment of the present invention.

In FIGS. 5, 6 and 7 showing an ignition distributor according to an embodiment of the present invention, a distributor proper 100 includes a housing 110 and a cap 120. The housing 110 includes a first cylindrical portion 111 and a second cylindrical portion 112 of larger size connected to the upper end of the first cylindrical portion 111. The cap 120 includes a distributor cap portion 121 for covering the second cylindrical portion 112 of the housing 110 and an ignition coil cap portion 122 for covering the ignition coil described later on the side of the distributor cap portion 121.

The cap 120 is mounted at the upper end of the second cylindrical portion 112 of the housing 110 by screws not shown. When mounting, a sealing ring 130 is inserted between the housing 110 and the cap 120 thereby to seal the contact therebetween. A pair of flanges 113 for fixing the distributor on the mounting portion on the internal combustion engine are formed on the housing 110.

A first rotary shaft 140 is inserted in the first cylindrical portion 111 of the housing 110, and the upper end thereof is positioned in the second cylindrical portion 112. This upper end is fitted with a cylindrical second rotary shaft (distribution shaft) 150, and the first and second rotary shafts 140 and 150 are coupled to each other by a well-known centrifugal advancing mechanism 160. The first rotary shaft 140, which has a gear 141 at the lower end thereof, is connected with the internal combustion engine not shown through a gear 141 and rotated in proportion to the rotational speed of the internal combustion engine. The second rotary shaft 150 is rotated by being advanced by the amount corresponding to the engine rotational speed with respect to the first rotary shaft 140 by the operation of the centrifugal advancing mechanism 160.

A plate 170 is fixed by screw 171 above the centrifugal advancing mechanism 160 in the second cylindrical portion 112 of the housing 110. The plate 170 is coupled with a cylindrical support member 172 through which the second rotary shaft 150 is inserted and rotatably supported on the support member 172 by a bearing bushing 151.

The signal rotor 1 is fixed on the second rotary shaft 150 upward of the support member 172, and an electromagnetic pickup 2 making up a rotation signal generator is arranged in the distributor proper 100 in opposed relation to the signal rotor 1. The signal rotor 1 has protrusions 1*a* of the same number as the cylinders of the internal combustion engine, here four protrusions, so that due to the function of each protrusion 1*a* by its rotation, a magnetic flux change is provided in the electromagnetic pickup 2 as explained above. The electromagnetic pickup 2 includes the coil 21 (FIG. 7) molded by resin 29, thus making up a coil unit 23 held by a first bracket 24, and a permanent magnet 22 sandwiched between the first bracket 24 and a second bracket 25. The second bracket 25 is rotatably held on the outer periphery of the support member 172 by the bearing bushing 26, whereby the whole of the pickup 2 is held. In this pickup 2, the magnetic flux generated by the permanent magnet 22 passes through a magnetic circuit (dashed line in FIG. 5) including the second bracket 25, the bearing 26, the distribution shaft 150, the signal rotor 1 and the first bracket 24, and links the pickup coil 21 in the coil unit 23. The pickup coil is sensitive to the magnetic flux in the radial direction of the signal rotor 1, and the magnetic flux changes with the rotation of the signal rotor 1 so that a rotation signal voltage is generated in the pickup coil as described above.

An electrical conductor making up the essential part of the present invention is arranged on the outer periphery of the coil unit 23 of the pickup 2. According to the embodiment under consideration, the conductor is comprised of a cylindrical conductor 80 which is fixed on the coil unit 23 by appropriate means such as bonding agent. The cylindrical conductor 80 is preferably made of copper or aluminum having a high conductivity.

The second bracket 25 of the pickup 2 is provided with a pin 27. A rod 181 of a well-known vacuum advancing mechanism 180 mounted on the housing 110 is coupled to this pin 27. Upon actuation of the vacuum advancing mechanism 180, the pickup 2 is rotated with respect to the support member 172 and hence with respect to the signal rotor 1. The rotation of the pickup 2 and the rotation of the second rotary shaft 150 (signal rotor 1) with respect to the first rotary shaft 140 causes a change in ignition timing as well known.

The ignition coil 4 is mounted on the distributor proper 100, or specifically on the side wall of the housing 110. For mounting this ignition coil 4, the second cylindrical portion 112 of the housing 110 is partly cut away, and a pair of supporting posts 114 are provided on both sides of the cut-away portion. The ignition coil 4, which is partly inserted in the cut-away portion, is fixed on the supporting posts 114 by the mounting bolts 46.

The ignition coil 4 includes a primary winding 41, a secondary winding 42, a pair of E-shaped cores 43, 43', a resin case 44 and a mold resin 45. The pair of cores 43, 43' forms an air gap 43'' between the central legs thereof. The primary and secondary windings 41 and 42 are wound on the central legs 43 and 43' coaxially with the secondary winding being positioned outside. This assembly is contained in the case 44 and molded by the mold resin 45 such as thermosetting epoxy resin filled and hardened in the case 44.

A flange 441 flush with the upper face of the housing 110 is provided on the side of the case 44 of the ignition coil 4, and is in contact with the ignition coil cap portion 122 of the cap 120 through the sealing ring 130. The ignition coil 4 is thus covered by the cap 120.

Figure 1:
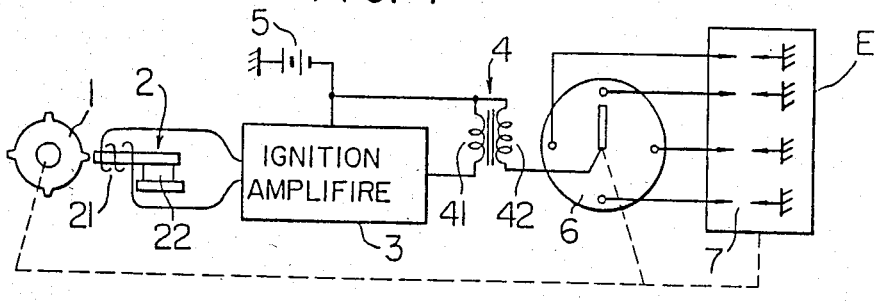
FIG. 1 is a circuit diagram of an ignition system to which the present invention is applied.
Figure 2:
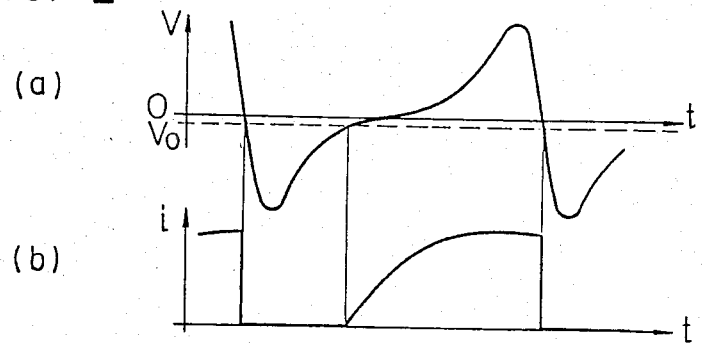
FIG. 2 shows waveforms for explaining the operation of the ignition system of FIG. 1.
Figure 3:
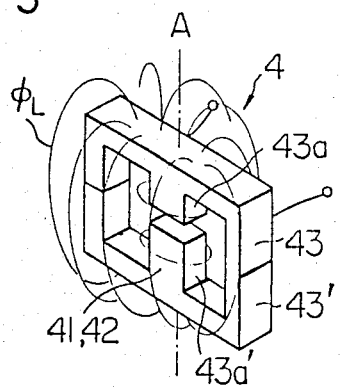
FIG. 3 is a diagram showing an example of the ignition coil used in the present invention.
Figure 4A:
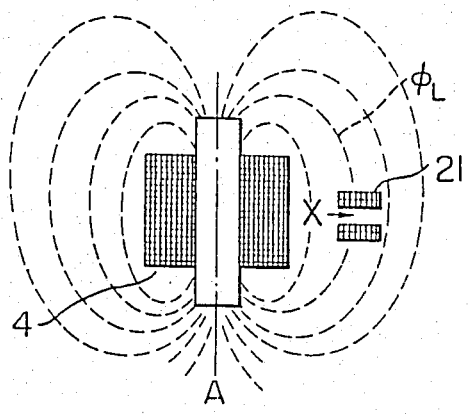
FIGS. 4*a* and 4*b* are diagrams showing examples of relative positions of the rotation signal generator means and the ignition coil.
Figure 4B:
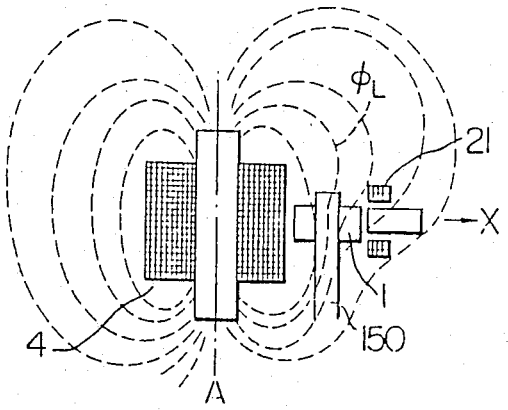

The ignition amplifier 3 shown in FIG. 3 is secured to the interior wall of the cylindrical portion 112 of the housing 110 by appropriate means such as screws not shown. The ignition amplifier 3 includes electronic elements arranged within a metal case 31 functioning also as a heat radiation plate which is surrounded by a resin case 32. The amplifier 3 is connected to the pickup 2 and the ignition coil 4 by lead wires 33 and 34 respectively. Lead wires 35 and 47 from the amplifier 3 and the ignition coil 4 are introduced outside through a grommet 190 attached on the housing 110 and are connected to a battery 5 (FIG. 1).

An end of a center electrode 200 is arranged at the center of the upper most part of the distributor cap portion 121 of the cap 120, together with a brush 202 loaded by a spring 201. A distribution rotor 210 is mounted at the upper end of the distribution shaft 150, and a rotor electrode 211 is fixed on the upper side of the distribution rotor 210. The brush 202 is in contact with the rotor electrode 211. The center electrode 200 extends toward the ignition coil cap portion 122, and has the other end thereof above the ignition coil 4, where a brush 204 is positioned and loaded by a spring 203. The ignition coil 4 includes a high voltage terminal 48 connected to the secondary winding 42, and a cylindrical tower 49 is integrally formed with the case 44, which surrounds the high voltage terminal 48. The brush 204 is in contact with the high voltage terminal 48. The high voltage generated across the ignition coil 4 is applied to the center electrode 200 and then introduced therethrough to the rotor electrode 211. The connection between the center electrode 200 and the ignition coil 4 is accomplished only by mounting the cap 120 on the housing 110.

Side electrodes 220, the number of which is the same as that of the cylinders of the engine (four in this case), are provided about the uppermost part of the distributor cap portion 121 of the cap 120. The side electrodes 220 are introduced toward a tower 123 protruded sideway of the cap 120. The side electrodes 220 are sequentially contacted to the rotor electrode 211 by the rotation of the distribution rotor 210 to be supplied with a high voltage. The high voltage is introduced to the spark plug 7 (FIG. 1) connected through a high voltage cord to the tower 123.

Figure 8:
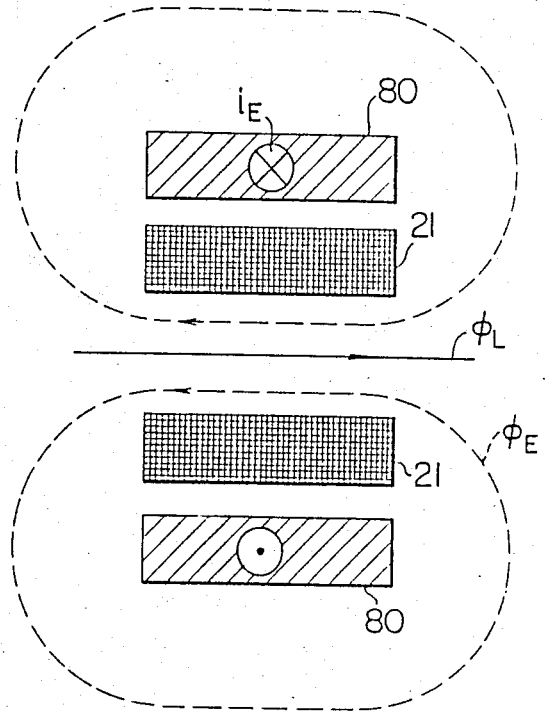
FIG. 8 is a diagram for explaining the function of an electrical conductor provided on the electromagnetic pickup shown in FIG. 7.

The function of the cylindrical conductor 80 in this construction will be explained with reference to FIG. 8. When the leakage magnetic flux $\emptyset_L$ generated by the ignition coil 4 links the pickup coil 21, a noise voltage corresponding to the leakage magnetic flux density is induced in the pickup coil 21. The leakage magnetic flux $\emptyset_L$ causes an eddy current $i_E$ to flow in the cylindrical conductor 80. The generation of the eddy current $i_E$ in turn generates a magnetic flux $\emptyset_E$ corresponding thereto. The leakage magnetic flux $\emptyset_L$ caused by the ignition coil 4 and the magnetic flux $\emptyset_E$ caused by the eddy current $i_E$ are opposite in direction, so that the leakage magnetic flux $\emptyset_L$ linking the pickup coil 21 are cancelled by the magnetic flux $\emptyset_E$ caused by the eddy current $i_E$, thereby reducing the noise voltage generated in the pickup coil 21 by the leakage magnetic flux $\emptyset_L$. Thus, the cylindrical conductor 80 has a current conducting path around the axis of the pickup coil 21 for the eddy current $i_E$. The eddy current $i_E$ is proportional to the rate of change of magnetic flux and inversely proportional to the resistance of the electric circuit (cylindrical conductor 80) through which the eddy current $i_E$ flows. Therefore, the higher the frequency of the leakage magnetic flux $\emptyset_L$ and the higher the conductivity of the conductor (as when copper is used instead of aluminum), the more effective result is obtained for the same shape of the cylindrical conductor 80. In addition to the noise voltage caused by the leakage magnetic flux $\emptyset_L$, the required rotation signal voltage will also be reduced by the eddy current generated in the cylindrical conductor 80. However, since the eddy current is proportional to the frequency of the linking magnetic flux as mentioned above, the eddy current is so small that the rotation signal voltage is not substantially attenuated in the low speed range where the output voltage of the rotation signal often poses a problem, thus causing no adverse effect on the ignition control. In order to reduce the resistance of the cylindrical conductor 80, the thickness of the wall thereof is preferably more than 3 mm for copper or more than 6 mm in the case of aluminum. In view of the limited space in the distributor proper, however, the wall thickness is preferably about 5 mm in case of the conductor 80 made of copper.

Figure 9:
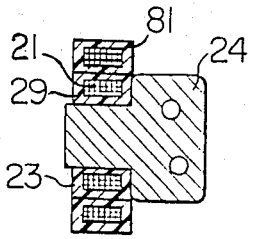
FIG. 9 is a sectional view of the electromagnetic pickup according to another embodiment of the present invention.

Another embodiment of the invention is shown in FIG. 9. In this embodiment, a second coil 81 is arranged on the outer periphery of the pickup coil 21 as a coiled conductor, which is integrally formed with the pickup coil 21 by the mold resin 29. The ends of the second coil 81 are short-circuited, and therefore, as in the preceding embodiment, an eddy current flows due to the leakage magnetic flux $\emptyset_L$ so that magnetic flux is generated in opposite direction to the leakage magnetic flux $\emptyset_L$, thereby to cancel the leakage magnetic flux $\emptyset_L$. The second coil 81 is also made of a material having high conductivity thereby to effectively reduce the electric resistance to the eddy current. It should be noted that if the wire diameter of the coil 81 is small or the ends of the coil 81 are connected through a resistor (including a contact resistance), the noise voltage is less attenuated undesirably. The wire diameter of the coil 81 is preferably about 0.5 mm.

It will be understood from the foregoing description that according to the present invention a malfunction of the ignition system due to the leakage magnetic flux of the ignition coil can effectively be prevented.

We claim:

1. An ignition system for an internal combustion engine comprising:

a distributor proper;

a rotary shaft arranged inside of the distributor proper and rotated in synchronism with the rotation of the engine;

a signal rotor mounted on the rotary shaft;

a rotational signal generator arranged in opposed relation to said signal rotor in said distributor proper, said rotation signal generator including a magnetic flux generator and a magnetic flux change sensor having an axis extending in a radial direction of said signal rotor, for detecting change in the magnetic flux due to the rotation of said signal rotor and producing a signal in synchronism with the rotation of the engine signal generator further including an electric conductor; and an ignition coil including a primary winding and a secondary winding, a current flow through said primary winding being controlled in accordance with the output signal of said rotation signal generator, a high voltage being induced in said secondary winding in accordance with the controlled current flow in said primary winding;

wherein said rotation signal generator further comprises an electrical conductor member arranged on the outer periphery of said magnetic flux change sensor and having a current conducting path around said axis of said sensor for producing an opposing magnetic flux when a leakage flux from said ignition coil crosses through said rotation signal generator, whereby a generation of a noise signal in said magnetic flux change sensor due to at least said leakage flux is suppressed.

2. An ignition system according to claim 1, wherein said magnetic flux change sensor includes a coil having said axis, and said conductor member includes a cylindrical conductor fixed on the outer periphery of said coil.

3. An ignition system according to claim 1, wherein said magnetic flux change sensor includes a coil having said axis, and said conductor member includes another coil arranged on the outer periphery of said coil, said coil and said other coil being insulated from each other and molded integrally by an insulating resin.

* * * * *